United States Patent [19]

Pomroy et al.

[11] Patent Number: 4,590,351

[45] Date of Patent: May 20, 1986

[54] COMPACT PORTABLE TURNTABLE FOR MICROWAVE OVENS

[75] Inventors: James F. Pomroy, St. Paul; Allen M. Danley, Eagan, both of Minn.

[73] Assignee: Plastics, Inc., St. Paul, Minn.

[21] Appl. No.: 715,110

[22] Filed: Mar. 22, 1985

[51] Int. Cl.[4] ..... H05B 6/78

[52] U.S. Cl. ..... 219/10.55 F; 219/10.55 E; 108/20; 126/338; 99/DIG. 14

[58] Field of Search ..... 219/10.55 E, 10.55 F; 108/20, 139, 141; 126/338 R; 99/DIG. 14, 443 R, 451

[56] References Cited

U.S. PATENT DOCUMENTS

| | | | |
|---|---|---|---|
| 4,210,794 | 7/1980 | Oguri | 219/10.55 F |
| 4,216,727 | 8/1980 | Cunningham | 219/10.55 F |
| 4,219,715 | 8/1980 | Mandle et al. | 219/10.55 F |
| 4,239,009 | 12/1980 | Cunningham | 219/10.55 F |
| 4,254,319 | 3/1981 | Beh et al. | 219/10.55 E |
| 4,258,630 | 3/1981 | Jorgensen et al. | 219/10.55 E |
| 4,308,445 | 12/1981 | Offutt | 219/10.55 F |
| 4,330,696 | 5/1982 | Pomroy et al. | 219/10.55 F |
| 4,330,697 | 5/1982 | Danley et al. | 219/10.55 E |
| 4,434,343 | 2/1984 | Bowen et al. | 219/10.55 F |
| 4,523,070 | 6/1985 | Jorgensen et al. | 219/10.55 F |

FOREIGN PATENT DOCUMENTS

| | | |
|---|---|---|
| 51-3146 | 1/1976 | Japan . |
| 52-92454 | 7/1977 | Japan . |

*Primary Examiner*—Philip H. Leung

*Attorney, Agent, or Firm*—Flehr, Hohbach, Test, Albritton & Herbert

[57] ABSTRACT

Compact turntable for use in microwave ovens. The drive motor assembly is positioned entirely beneath the rotating platform having a ring of inwardly facing gear teeth and has a relatively low profile. This turntable can be utilized in smaller oven cavities than bulkier turntables heretofore provided.

6 Claims, 2 Drawing Figures

COMPACT PORTABLE TURNTABLE FOR MICROWAVE OVENS

This invention pertains generally to microwave heating and cooking apparatus, and more particularly to a portable turntable for use in a microwave oven.

In recent years, portable turntables have been provided for use in microwave ovens. In most of these turntables, the drive motor is positioned beneath the rotating platform, usually in an enclosure intended to shield the metallic components of the drive motor assembly from microwave radiation. Examples of such turntables are found in U.S. Pat. Nos. 4,216,727, 4,219,715, 4,239,009, 4,254,319, 4,258,630, 4,434,343, and Japanese Utility Model Applications Nos. 51-3146 and 52-92454. These turntables have certain limitations and disadvantages. The size of the drive mechanism generally requires the platform to be located a substantial distance above the floor of the oven cavity. This limits the height of food products which can be cooked and positions the food products out of the region in which some ovens heat most effectively. Most of these turntables also have relatively large shields for the drive motors assemblies, and these shields can interfere with the distribution of microwave energy within the oven cavity.

U.S. Pat. No. 4,330,696 describes a portable turntable in which the drive motor is positioned to one side of the platform, thereby avoiding the problems of turntables having the drive motor beneath the platform. However, some newer microwave ovens have cavities which are too small to accommodate a drive motor positioned to the side of the platform unless the diameter of the platform is reduced.

It is in general an object of the invention to provide a new and improved turntable for use in microwave ovens.

Another object of the invention is to provide a new and improved turntable of the above character which is compact and can be used in relative small oven cavities.

These and other objects are achieved in accordance with the invention by providing a portable turntable having a relatively shallow base which rests on a supporting surface in the oven cavity. A platform having a ring of inwardly facing gear teeth is removably mounted on the base for rotation about a vertically extending axis. A drive motor assembly enclosed in a relatively flat housing of limited vertical extent is removably mounted in a pocket in the base beneath the platform, with an output gear in driving engagement with the ring of gear teeth for rotating the platform about the vertically extending axis.

Figure 1:
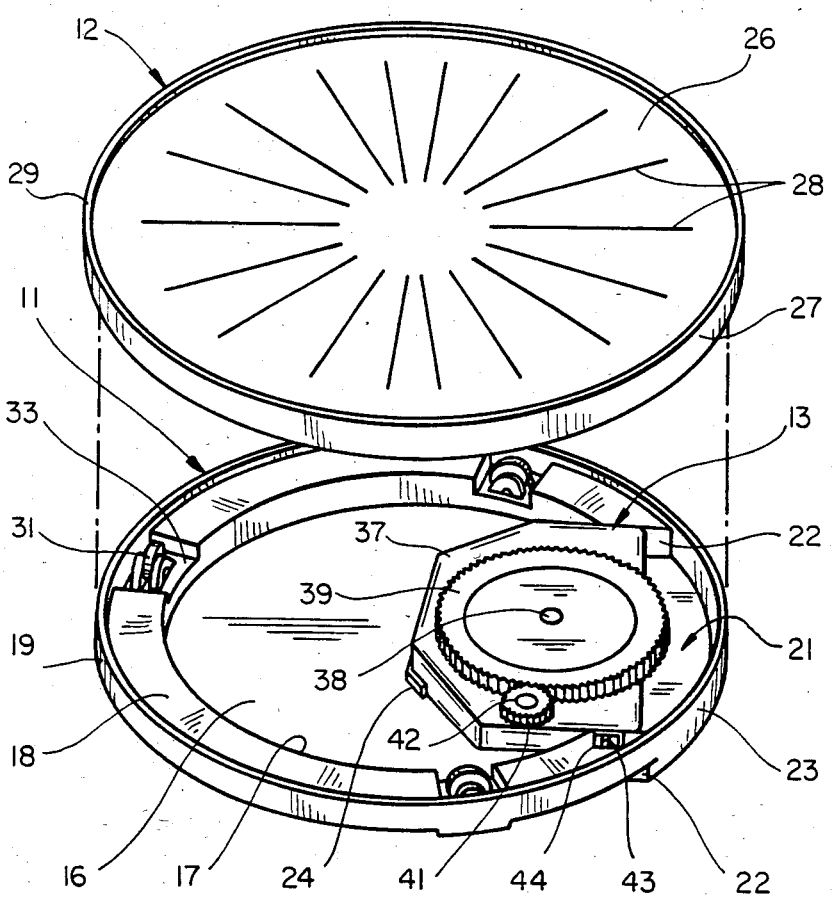
FIG. 1 is an exploded isometric view, partly broken away, of one embodiment of a turntable according to the invention.
Figure 2:
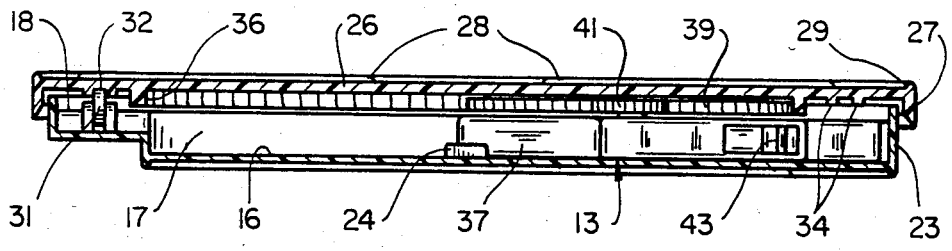
FIG. 2 is a centerline sectional view of the embodiment of FIG. 1.

As illustrated in the drawings, the turntable comprises a relatively shallow base 11 adapted to rest on a supporting surface such as the floor of a microwave oven cavity, a food supporting platform 12 rotatively mounted on the base, and a drive motor assembly 13 removably mounted on the base beneath the platform for rotatively driving the platform.

Base 11 has a generally circular bottom wall 16, with a relatively short upstanding cylindrical wall 17 at the periphery of the bottom wall. An annular rim 18 extends outwardly from the upper margin of the side wall, with an upstanding lip 19 at its outer periphery.

Drive motor 13 is removably mounted in a pocket 21 toward one side of the base. In this region, bottom wall 16 extends beyond side wall 17 to the outer perimeter of the base, and side wall 17 and rim 18 terminate at the sides of the pocket, with generally parallel, upstanding side walls 22 at these points. The outer side of the pocket is closed by an arcuately curved side wall 23 which connects with bottom wall 16 and side walls 22 and forms an extension of lip 19 at the outer periphery of rim 18. Upstanding angular flanges 24 are provided toward the central portion of bottom wall 16 and engage the inner corners of the motor housing.

Platform 12 comprises a generally planar horizontally extending deck 26 with a depending peripheral skirt 27. Radially extending ribs 28 and a peripheral rim 29 project upwardly from the upper surface of the platform deck.

The platform is rotatively mounted on the base and constrained for rotation about a vertical axis by rollers 31 which are received in a track 32 on the underside of the platform. The rollers are mounted on base 11 in recessed areas 33 in rim 18. The rollers are spaced about the axis of rotation, and in the embodiment illustrated three rollers are provided. Track 32 is formed by a pair of spaced apart concentric ribs or flanges 34 which project in a downward direction on the underside of the platform. The rollers are received between the flanges to constrain the platform for rotation about the axis of the base, and the rollers engage the underside of the platform deck between the flanges, whereby the platform is supported for rolling movement about the axis.

A ring of inwardly facing gear teeth 36 is also provided on the underside of the platform. These teeth are spaced inwardly of the track flanges and centered about the axis of rotation.

In one presently preferred embodiment, base 11 and platform 12 are each fabricated as a unitary structure of a plastic material which does not interact with microwave energy. One presently preferred material is a modified thermoset plastic as used in the MICROWARE cookware of Plastics, Inc., St. Paul, Minn. Other suitable materials for a turntable intended for use in a microwave oven include polysulfone, thermoplastic polyesters, polypropylene, polycarbonate, polystyrene, acrylonitrile, butadiene, styrene, polyphenylene oxide, acrylic and polyethylene.

Drive motor assembly 13 is a spring powered motor assembly of the type described in detail in pending application Ser. No. 397,326, filed July 12, 1982. This motor assembly is self-contained and includes a relatively flat housing 37 fabricated of a material which does not interact with microwave energy. An energy storage spring is mounted in a relatively small shielding enclosure within the housing and connected to an arbor 38. The arbor extends through suitable openings in the shielding enclosure and the motor housing, and an output gear 39 is affixed to the upper end of the arbor. The speed at which the output gear rotates is regulated by an escapement mechanism mounted within the housing in the same horizontal plane as the drive spring. The output gear is coupled to the escapement mechanism by a gear 41 affixed to a shaft 42 which extends into the housing. An ON/OFF switch 43 is manually engageable with the pendulum in the escapement mechanism to prevent rotation of the output gear. The handle of the switch projects through an opening 44 in one of the pocket walls 22. Output gear 39 meshes with ring gear 36 for rotating the platform about its axis. The drive spring is round by rotating the platform manually about the axis of the base with the ON/OFF switch in the OFF position.

Both the platform and the drive motor assembly are readily installed and removed from the base. The motor assembly simply drops into pocket 21 and is securely retained by walls 16, 22 and 23 and flanges 24. The platform drops over the motor assembly and base, with rollers 31 being received in track 32 and gears 36 and 39 in meshing engagement.

The turntable is very compact and has a relatively low profile which makes it particularly suitable in microwave ovens with smaller cavities. The overall height of the turntable is only slightly greater than would be required if motor assembly 13 were mounted beside the platform rather than beneath it. With the motor assembly positioned beneath the platform, the turntable can be used in ovens where there would not be enough room to use a turntable with the motor assembly mounted beside the platform. All of the components of the turntable except the motor spring and the enclosure in which the spring is mounted are fabricated of materials which do not interact with microwave energy. With this relatively small enclosure, the drive motor assembly can be positioned beneath the platform without significant interference with the distribution of microwave energy within the oven cavity. The peripheral driving arrangement requires less driving torque than turntables which are driven by a central axle, and this permits the use of a smaller drive motor.

It is apparent from the foregoing that a new and improved turntable has been provided. While only one presently preferred embodiment has been described in detail, as will be apparent to those familiar with the art, certain changes and modifications can be made without departing from the scope of the invention as defined by the following claims.

We claim:

1. In a portable turntable for use in a microwave oven: a relatively shallow base which rests on a supporting surface in the oven cavity, a platform mounted on the base for rotation about a vertically extending axis, said platform having a ring of gear teeth centered about the axis and facing inwardly toward the axis, and a drive motor assembly removably mounted on the base beneath the platform with an output gear positioned within and in driving engagement with the ring of gear teeth for rotating the platform about the vertically extending axis.

2. The turntable of claim 1 wherein the drive motor assembly is enclosed in a relatively flat housing of limited vertical extent which rests in a pocket in the base.

3. The turntable of claim 1 including a circular track positioned concentrically of the axis on the underside of the platform, and a plurality of rollers mounted on the base in rolling engagement with the track to constrain the platform for rotation about the axis.

4. The turntable of claim 3 wherein the track comprises a concentric pair of flanges which depend from the underside of the platform, and the rollers engage the underside of the platform between the flanges.

5. In a portable turntable for use in a microwave oven: a base which rests on a supporting surface in the oven cavity, a plurality of rollers mounted on the base and spaced about an axis, a platform resting on the rollers and having a circular track which engages the rollers and constrains the platform for rotation about the axis, and a drive motor assembly removably mounted on the base beneath the platform and having an output gear in driving engagement with a ring of inwardly facing gear teeth on the underside of the platform for rotating the platform about the axis.

6. The turntable of claim 5 wherein the track comprises a concentric pair of flanges which depend from the underside of the platform, and the rollers engage the underside of the platform between the flanges.

* * * * *